United States Patent [19]

Myers et al.

[11] 4,117,697

[45] Oct. 3, 1978

[54] ROLL-IN OPEN-FRONT FROZEN FOOD REFRIGERATION CASE

[75] Inventors: James E. Myers; Tom E. Kennedy, both of Niles, Mich.

[73] Assignee: Tyler Refrigeration Corporation, Niles, Mich.

[21] Appl. No.: 764,157

[22] Filed: Jan. 31, 1977

[51] Int. Cl.[2] ..... A47F 3/04

[52] U.S. Cl. ..... 62/256

[58] Field of Search ..... 62/237, 250, 255, 256, 62/257

[56] References Cited

U.S. PATENT DOCUMENTS

| | | | |
|---|---|---|---|
| 2,923,137 | 2/1960 | Swanson | 62/256 |
| 3,119,241 | 1/1964 | Wile | 62/256 |
| 3,123,988 | 3/1964 | Richman | 62/256 |
| 3,139,737 | 7/1964 | Wile | 62/256 |
| 3,289,432 | 12/1966 | Brennan et al. | 62/256 |
| 3,304,736 | 2/1967 | Brennan et al. | 62/256 |
| 3,392,543 | 7/1968 | Miller | 62/237 |
| 3,621,672 | 11/1971 | Meredith | 62/237 |
| 3,698,205 | 10/1972 | Perez | 62/256 |
| 4,023,378 | 5/1977 | Kennedy et al. | 62/256 |
| 4,034,572 | 7/1977 | Morris et al. | 62/256 |

FOREIGN PATENT DOCUMENTS

| | | | |
|---|---|---|---|
| 2,230,159 | 12/1974 | France | 62/256 |
| 377,632 | 6/1964 | Switzerland | 62/256 |

*Primary Examiner*—Lloyd L. King

*Attorney, Agent, or Firm*—LeBlanc & Shur

[57] ABSTRACT

A commercial refrigerator, having an open front display section and a rear storage section in which first air circulating fans draw air from the storage section and propells it through refrigeration coils to a bifurcated conduit for which directs at least some refrigerated air propelled by the first fans through the refrigeration coils along a first path directly into the storage section and for directing other refrigerated air propelled by the first fans through the coils along a second path directly across the open front of the display section to form an inner air curtain; return fans are provided for directing the downstream end of the inner air curtain along the floor of the display section and into the storage section; a second set of air circulating fans are provided in a further conduit for directing air around the exterior of the storage and display sections and across the access opening to form an outer air curtain; and a divider is provided which separates the display and storage sections, the divider containing an access opening for communicating the storage and display sections.

29 Claims, 3 Drawing Figures

FIG. 1
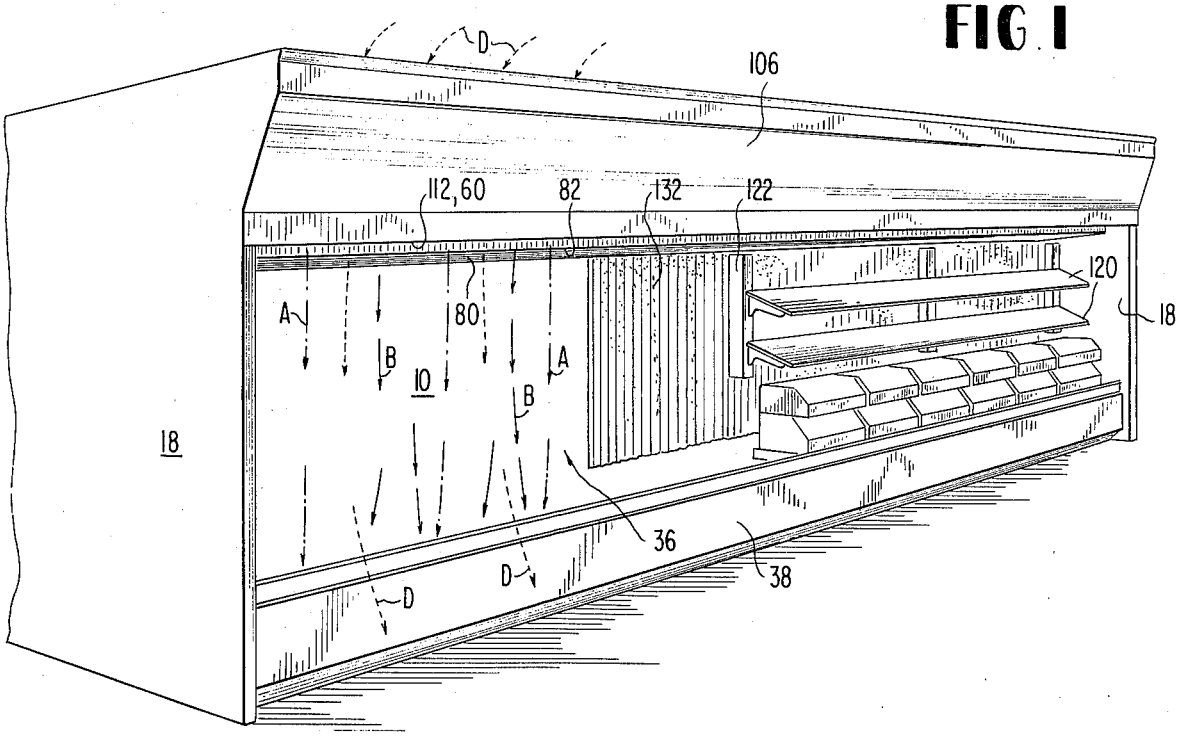
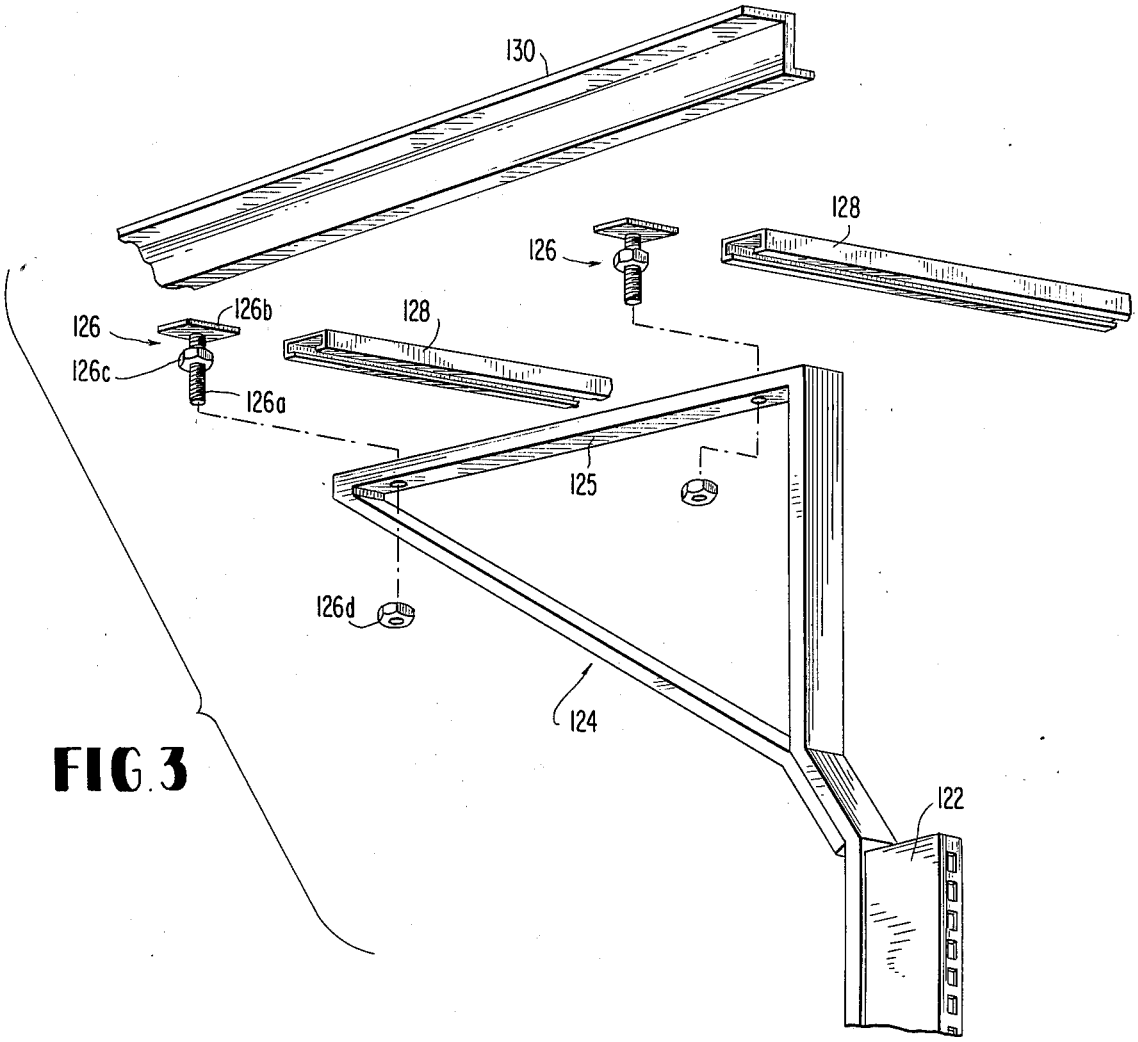
FIG. 3

ROLL-IN OPEN-FRONT FROZEN FOOD REFRIGERATION CASE

BACKGROUND OF THE INVENTION

This invention relates to frozen food display cases, and particularly to the roll-in type.

The invention is particularly suited for supermarket construction in which the display case is open at the front to permit continuous and easy consumer access to frozen food products contained in the display area. In the particular construction contemplated, frozen food products are loaded onto rolling carts. Loaded rolling carts are rolled from a rear storage area into the display area and empty carts may be rolled out of the display area back to the storage area for refilling.

Various types of open front refrigerated display cases are well known. Some examples described in the patent literature include: Henderson, U.S. Pat. No. 2,450,088; Swanson, U.S. Pat. No. 2,923,137; Kennedy, U.S. Pat. No. 2,961,845; Barroero, U.S. Pat. No. 2,962,875; Rainwater, U.S. Pat. No. 2,984,085; Jacobs, U.S. Pat. No. 3,021,691; Mathis, U.S. Pat. No. 3,044,274; Fanick, U.S. Pat. No. 3,063,225; Richman, U.S. Pat. No. 3,123,988; Wile, U.S. Pat. No. 3,139,737; Jarvis, U.S. Pat. No. 3,139,738; and Brennan, U.S. Pat. No. 3,499,295.

Heretofore, commercial refrigerators, such as exemplified in the disclosures of the above-mentioned patents, have been more or less designed for special purposes; that is, the designs are based on compromises between the display arrangements and duct work. This, of course, necessitates that a different type of refrigerator be designed and built each time a different type of display is desired.

It is an object of the present invention to provide a standardized design in which the refrigeration equipment is relatively independent of the desired display configuration.

It is a further object of the invention to provide a walk-in or roll-in rear load refrigerator having an open front display section and a rear storage section which is capable of utilizing a variety of display configurations.

It is a further object of the invention to provide a unitized refrigeration circuit which is usable for a variety of shelf and/or cart display configurations.

It is a further object of the invention to provide a bifurcated primary refrigeration air circuit to simultaneously cool the storage section and display section.

It is a further object of the invention to provide this bifurcated primary refrigeration circuit in combination with a secondary unrefrigerated, but colder than ambient temperature, cooled loop, so that the two circuits provide primary and secondary air curtains across the open front of the display case.

It is a further object of the invention to provide a third ambient air curtain across the open front of the display case which further inhibits infiltration of moisture into the display area and which is dissipated into the aisle in front of the display case.

It is a further object of the invention to provide a refrigerated air flow within the display section that is capable of effectively cooling food products stored on individual shelves in the display section.

This invention accomplishes the above and other objects in the following manner.

SUMMARY OF THE INVENTION

A rear load, open front commercial refrigerator has an outer cabinet and an inner cabinet spaced from the outer cabinet, both of which have open fronts. The space between the inner and outer cabinets comprises a secondary air band duct or conduit system in which a plurality of fans are located for propelling air through this conduit and downwardly across the open front of the display case to provide an outer or secondary air curtain. The interior of the cabinet is divided into a front display section and a rear storage section; a plenum chamber containing refrigeration coils is located in a housing above the display section. At the upstream end of the housing a plurality of fans draw air from the storage section and propells it through the refrigeration coils; at the downstream end of the coils is a bifuracted duct which splits the refrigerated air into two paths. Refrigerated air flowing along the first path, flows downwardly across the open front of the display case to form an inner air curtain relative to the outer or secondary curtain; the inner air curtain is drawn through evaporation coils located along the bottom edge of the open front where it is demoisturized and propelled by a further fan along the bottom of the display section back into the storage section, where it rises and is returned by the first fan through the refrigeration coils. Air flowing along the second path is drawn directly back into the storage section for cooling purposes; this air too loops back and is drawn by the first fan through the refrigeration coils again.

An air impervious divider, in the form is a flexible plastic curtain, is hung between the display and storage sections. This curtain provides a baffle for directing a further stream of primary or refrigerated air (bled from the first refrigerated air path) downwardly along the rear of the display section; portions of this additional refrigerated stream may be diverted by shelves extending into the air path so that a portion of this further air stream is diverted across the top of the shelf and back toward the front where it mixes with the main inner air curtain stream.

The shelves may be hung on uprights which in turn are adjustably and hangingly mounted from support members located in the ceiling of the storage section.

BRIEF DESCRIPTION OF THE DRAWING

FIG. 1 is a front perspective view of the open front refrigerated display cabinet;

FIG. 3 is a detail of the adjustable shelf mounting arrangement.

DESCRIPTION OF A PREFERRED EMBODIMENT

Figure 2:
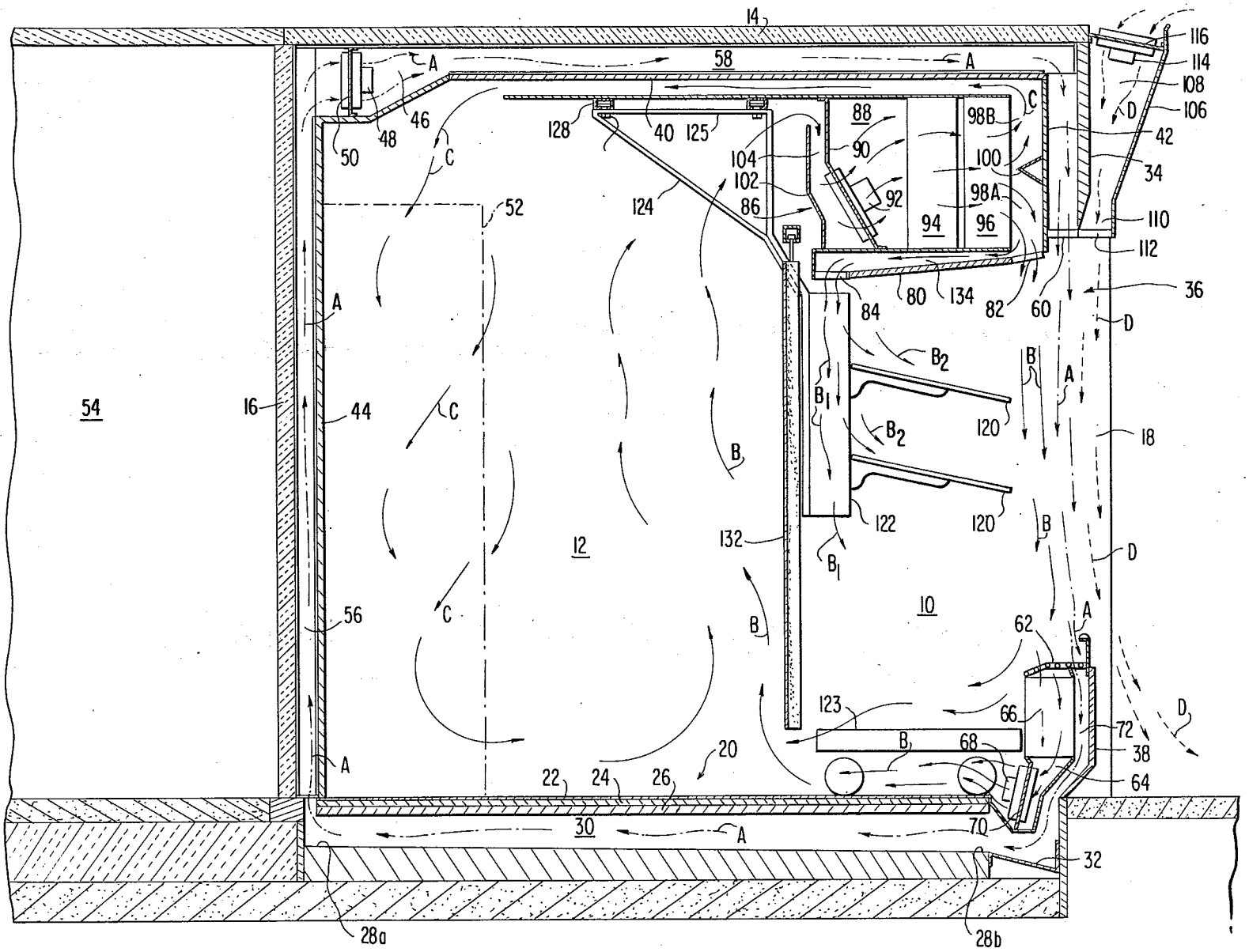
FIG. 2 is a cross sectional side view.

Referring particularly to FIG. 2, the roll-in frozen food refrigerator comprises a cabinet having two main regions, an open front display section 10 and a rear storage and access section 12. The cabinet is composed of an insulated top member 14, an insulated rear wall 16, side walls 18 and a floor, generally designated 20.

In one exemplary, but not limitative embodiment, the floor 20 may comprise a steel plate 22, a plywood subfloor 24 below steel plate 22 and an insulation panel 26 below subfloor 24. The cabinet floor 20 is raised above the store floor or subfloor 28 to provide space for a duct 30 under the refrigerated cabinet. The store floor 28 may advantageously be inclined downwardly from one end 28*a* to a second end 28*b* to permit water drainage to occur by gravity flow toward a floor drain 32.

An upper front face panel 34 extends downwardly from the front end of top member 14 along the front of the display case to define the upper edge of the display section access opening 36. A lower front face panel 38 extends up from the floor along the length of the display case to define the lower edge of the access opening 36.

Interiorly of and spaced from the corresponding outer cabinet wall members are an interior top member 40, an interior front panel 42 and an interior rear wall 44. Interior top member 40 terminates at its rearmost portion and interior rear wall 44 terminates at its uppermost end in a plenum chamber 46 housing a plurality of fans 48 mounted in a baffle plate 50 which separates the plenum chamber 46 into upstream and downstream sections in a known manner.

Rear walls 16 and 44 are not solid across the back of the cabinet, but rather contain access openings which may be closed by doors 52, as indicated by dashed lines. These doors may be double action swinging doors to provide access between the cabinet and a rear freezer storage room 54, large enough for rolling carts to be wheeled through. Outer cabinet wall 16 and inner wall 44 define between them a duct 56 which extends around the above-described access openings and which is a continuation of duct 30. Duct 56 outlets into the upstream side of plenum chamber 46.

Outer top and front members 14 and 34, respectively, and inner top and front members 40 and 42, respectively, define a duct 58 which opens at its upstream end into the downstream side of plenum chamber 46 and terminates at its downstream end in a downwardly directed outlet covered by directional louvers 60, having, for example, a honeycomb shape.

A grillwork 62 extends from the top of lower base panel 38 partially into display section 10. Grill 62 covers a plenum chamber 64 housing a set of evaporation coils 66 and a plurality of fans 68 which are mounted in a baffle plate 70 in similar fashion to the mounting of fans 48. Plenum chamber 64 is spaced from lower face panel 38 to define a duct 72 therebetween. Grill 62 covers the upstream, inlet end of duct 72. Duct 72 outlets into the upstream end of duct 30.

Ducts 72, 30, 56, and 58 together define a secondary air circuit flow path (indicated by dot-dashed arrows A). Air is propelled along this flow path A by fans 48 through duct 58, through outlet louvers 60, and downwardly across the open front of the display section 10; fans 48 create a relatively negative pressure at the inlet end of duct 72 to draw the downwardly moving air propelled out of outlet louvers 60 into and through ducts 72, 30 and 56 to complete the circuit.

At its top, display section 10 is bounded by a ceiling panel 80 extending across the length of the refrigerator cabinet. Ceiling panel 80 is bounded at its front and rear by directional louvers 82 and 84, respectively, similar to louvers 60; louvers 82 are fixed between the front end of the panel 80 and the bottom of inner front panel 42. A housing 86 containing a plenum chamber 88 is located above and spaced from ceiling panel 80. The plenum chamber 88 is divided into an upstream portion and a downstream portion by a baffle 90 in which a plurality of fans 92 are mounted in similar fashion to the mounting of fans 48 and 68. The downstream section of plenum chamber 88 contains refrigerated coils, advantageously two sets of (e.g. 24 tube) refrigeration coils 94, 96, through which air is forced by the action of fans 92.

Coils 94 and 96 are finned, as is conventional; preferably, the fins of coil set 94 are more widely spaced apart than those of coil set 96. This arrangement provides an efficient frost collection system. The upstream set of coils 94 will collect the greater amount of frost as the air is initially cooled; the use of widely spaced fins allows better air flow during frost build-up. The closely spaced finned coils 96 downstream of coils 94, although more prone to frost buildup than the wider spaced fins, collect less frost because the air passing over them is substantially dried out from passing over coils 94.

The front of housing 86 is spaced from the inner front panel 42 and the top of housing 86 is spaced from inner top member 40 to define a bifurcated primary air circuit conduit 98 having two sections 98A and 98B. At its downstream end, primary air circuit conduit 98A terminates at directional louvers 82. Primary air circuit conduit 98B opens at its downstream end directly into the storage section 12. Advantageously, a baffle plate 100 (e.g. triangular in shape) may be located in conduit 98 to aid in directing air exiting from the downstream side of coils 94, 96 into ducts 98A and 98B, respectively, propelled by the action of fans 92.

The refrigerated air flowing into and through duct 98A exits at the downstream end of duct 98A through directional louvers 82, which may direct air at an acute angle of, for example, 10°, downwardly across the open front of display section 10 to form an innermost air curtain. Fans 68 create a negative suction in the upstream section of plenum chamber 64 to draw air forming the innermost air curtain through inlet grill 62 and (e.g. 12 tube) evaporation coils 66. The evaporated air is drawn through fans 68 and returned to storage section 12 along the bottom of display section 10. Coils 66 remove moisture picked up by the air flowing across the open front of the display section at its point of entry into the return portion of the primary loop. Absent coils 66, it is possible that moisture in the air in the primary loop return path would condense and be blown back into the storage section 12 in the form of snow.

A second portion of refrigerated air exiting from the coils 94, 96 is directed into primary air circuit duct portion 98B, through which it flows directly into storage section 12.

It will be seen that the primary refrigerated air circuit comprises two main loops. The first loop (indicated by solid line arrows B) contains air propelled by fans 92 through the refrigeration coils 94, 96, through duct 98A, through outlet louvers 82 and across the open front of display section 10, through return inlet 62 and evaporation coils 64, from which it is propelled by fans 68 along the bottom of display section 10 and into storage section 12. The second loop, (indicated by solid line arrows C) contains air propelled by fans 92 through refrigeration coils 94, 96 and duct 98B directly into storage section 12. The air entering the top of storage section 12 along path C co-mingles with the air returned along the bottom through path B; the upstream side of plenum chamber 88 is in open communication with storage section 12 and air is drawn into the plenum chamber by the negative pressure in the upstream section due to the action of fans 92.

The back of the housing 86 consists of a panel 102 which extends generally upwardly from the housing bottom to a point near but spaced from the housing top. Baffle 90 and panel 102 between them define the upstream side of plenum chamber 88 and a short duct 104 which, at its downstream end is in open communication with the upstream side of plenum chamber 88 and at its upstream end is in open communication with storage section 12. Fans 92 thus draw air from storage section 12 into and through duct 104 and into the upstream side of plenum chamber 88 to complete the primary refrigerated air circuit.

The storage area 12 acts very much in the manner of a large plenum chamber and air flow within this section is not of paramount concern. An advantage of providing a return loop for path B along the floor of the cabinet is that additional sheet metal which would otherwise have been necessary to duct the return refrigerated air flow can be omitted; it has been found that this extra ducting or sheet metal layer is unnecessary with the present invention to provide effective cooling.

The refrigerator thus far described provides a primary inner refrigerated air curtain along path B and a secondary outer air curtain along path A which forms a protective guard curtain of air contiguous with the primary refrigerated inner air curtain B across the open front of the display section to prevent infiltration of ambient room air into the display section 10. The temperature of the secondary air curtain A is somewhat higher than the temperature of the primary refrigerated air curtain B, but below ambient temperatures. The secondary air curtain is not specifically refrigerated, but is cooled by conduction from the interior of the cabinet. By circulating the secondary air loop around the cabinet between the inner and outer walls, an additional insulating layer is provided to reduce heat transfer between the store and the interior of the refrigerator.

Advantageously, a third ambient air curtain (indicated by dotted line arrows D) may also be provided. As shown in FIG. 2, a canopy or housing 106 is mounted to downwardly extending front wall 34; housing 106 and front wall 34 define between them a plenum chamber 108 which opens at its downstream end into a short duct 110. Directional louvers 112 extend across the downstream opening of duct 110.

A plurality of fans 114 are mounted in a baffle plate 116 which extends across tha upstream end of chamber 108 and along the length of the refrigerator cabinet. Fans 114 draw ambient store air into chamber 108 and propell it through duct 110 and directional louvers 112 downwardly across the open front of the display section to be discharged along the outside of the case. This third air curtain is not recirculated but exits into the aisle area of the store so that the ambient air can warm the aisle for customer comfort as well as adding inertia to the total air curtain formed by the primary and secondary air curtains.

One of the advantageous features of this invention is that the display section can be configured in any of a number of ways to most effectively display food products without altering the air circuits in any way. This obviously permits a standardization of the basic refrigerator components not heretofore possible from a practical standpoint. One particularly novel and advantageous arrangement is shown, the details of which are described below with particular reference to FIGS. 2 and 3. One or more shelves 120 (two of which are shown) may be hung from upright members 122 which are slotted to accommodate shelf brackets in a conventional manner. The uprights 122 may have any desired length; in the embodiment shown, the bottoms of the uprights 122 are spaced above floor 20 a sufficient distance to permit carts 123 loaded with merchandise to be rolled under them toward and into the display section.

Each upright member 122 is part of a larger assembly comprising a triangular gusset 124. The top leg 125 is drilled out to accommodate screw threaded mounting pieces 126. Each mounting piece consists of a threaded shaft **126*a* mounted on a base plate 126*b*. The shaft 126*a* passes through the drilled opening in gusset leg 125 and may be secured by two bolts 126*c* and 126*d* which permit vertical alignment as necessary. Mounting plates 126*b* fit in and are slideable along continuous rails 128 having a C-shaped hollow cross section. The rails 128 advantageously run the length of the refrigerator and may advantageously be suspended from structural ceiling members 130**, to which they may be secured, e.g. by welding. By this arrangment, the uprights are easily adjustable along the length of the refrigerator cabinet to permit a wide variety of shelving arrangements.

One or more flexible plastic curtains 132 may be located behind or between the uprights 122. Like the uprights, the curtains 132 may have any desired length although they must be spaced from the refrigerator cabinet floor 20 to provide a clear return flow path for primary loop B along the bottom of display section 10 and into storage section 12. The curtains 132 are relatively air impervious and form a divider between the display and storage sections. The curtains also function to direct a flow of air along the rear of the display section. The curtains are also movable along a track, for example, to permit access to the display shelves from the storage section.

As noted above, the bottom of housing 86 is spaced from the ceiling panel 80; a duct 134 is thereby defined which extends, at its upstream end, from duct 98A, to directional louvers 84 at its downstream end. A portion of the refrigerated primary air flowing through duct 98A is diverted through duct 134 and directed by directional louvers 84 to flow downwardly across the back of the display section (along the path indicated by arrows $B_1$). Shelves 122 are arranged such that a greater or lesser portion of their rear edges protrude into this flow path $B_1$. A portion of the air flowing downwardly across the back of the display section is thus diverted by the shelf acting as a baffle to flow across the top of a shelf and back toward the front of the display section (along the path indicated by arrows $B_2$) where it mixes with the air forming the inner air curtain. The amount of air so diverted depends on the extent to which the rear edge of the shelf impinges on the rear downward flow path $B_1$. That portion of the air which is not returned to the front of the display section to mix with the inner air curtain flows downwardly toward the bottom of the display section where it is returned under the bottom of the curtains 132 to the storage section along with air being positively propelled by fans 68.

The additional primary circuit air flow along the rear of the display section and over the tops of the shelves results in an effective cooling of the food products on the shelves without the use of complicated or customized duct systems.

It has been found that the following air velocities will provide effective and efficient cooling of the display and storage sections while maintaining effective air curtains across the open front of the display section:

| AIR BAND | AIR VELOCITIES (ft/min) | |
|---|---|---|
| | Supply | Return |
| Refrigerated (primary air band) | 700 | 600 |
| Secondary air band | 650 | 850 |

-continued

| AIR BAND | AIR VELOCITIES (ft/min) Supply | Return |
|---|---|---|
| Ambient air band | 650 | — |
| Rear curtain air band | 400 | — |
| Storage room | 400 | — |

With these typical velocities, the storage section can be maintained at a temperature of 0° F., plus or minus 10° by the refrigerated air flow.

While a specific embodiment of the invention has been shown and described in detail, it will be understood that the invention may be modified without departing from the spirit of the invention principles as set forth in the hereafter appended claims.

What is claimed is:

1. In a commercial refrigerator, suitable for use in supermarkets, having an open front display section and a rear storage section, the improvements comprising:

first air circulating fan means, and refrigeration coil means located downstream of said first fan means, wherein said first fan means is disposed to draw air from said storage section and propell said air through said refrigeration coil means;

first conduit means located downstream of said coil means for directing at least some refrigerated air propelled by said first fan means through said refrigeration coil means along a first path directly into said storage section and for directing other of said refrigerated air propelled by said first fan means through said coil means along a second path directly across the open front of said display section to form a relatively inner air curtain;

means for directing the downstream end of said inner air curtain across the front of said display section and into said storage section;

second air circulating fan means; and further conduit means for directing air propelled by said second fan means around the exterior of said storage and display sections and across said access opening to form a relatively outer air curtain.

2. A refrigerator according to claim 1, further comprising:

means for diverting a portion of the refrigerated air propelled along said second path and for directing the diverted portion to flow first rearwardly across the top of the display section and then downwardly along the rear of the display section.

3. A refrigerator according to claim 2, further comprising:

means mounting at least one shelf in said display section, said shelf acting to divert at least a portion of the air flowing downwardly along the rear of the display section to flow toward the front of the display section and mix with the air forming said inner air curtain.

4. A refrigerator according to claim 3, further comprising: means mounting a second shelf in said display section below the first shelf, said second shelf diverting at least a second portion of air flowing downwardly along the rear of the display section and past said first shelf to flow toward the front of the display section and mix with the air forming said inner air curtain.

5. A refrigerator according to claim 1, further comprising means for propelling and directing ambient air across said access opening to form a third air curtain exterior to said outer air curtain, said third air curtain being dissipated back into the atmosphere at its downstream end.

6. In a commercial refrigerator, suitable for use in supermarkets, having an open front display section and a rear storage section, the improvements comprising:

first air circulating fan means, and refrigeration coil means located downstream of said first fan means, wherein said first fan means is disposed to draw air from said storage section and propell said air through said refrigeration coil means;

first conduit means located downstream of said coil means for directing at least some refrigerated air propelled by said first fan means through said refrigeration coil means along a first path directly into said storage section and for directing other of said refrigerated air propelled by said first fan means through said coil means along a second path directly across the open front of said display section to form a relatively inner air curtain;

means for directing the downstream end of said inner air curtain across the front of said display section and into said storage section;

second air circulating fan means;

further conduit means for directing air propelled by said second fan means around the exterior of said storage and display sections and across said access opening to form a relatively outer air curtain; and divider means separating said display and storage sections, said divider means containing an access opening for communicating said storage and display sections.

7. A refrigerator according to claim 6, further comprising:

means for diverting a portion of the refrigerated air propelled along said second path and for directing the diverted portion to flow first rearwardly across the top of the display section and then downwardly along the rear of the display section in front of said divider means.

8. A refrigerator according to claim 7, further comprising:

means mounting at least one shelf in said display section, said shelf acting to divert at least a portion of the air flowing downwardly along the rear of the display section in front of said divider means to flow toward the front of the display section and mix with the air forming said inner air curtain.

9. A refrigerator according to claim 8, further comprising: means mounting a second shelf in said display section below the first shelf, said second shelf diverting at least a second portion of air flowing downwardly along the rear of the display section and past said first shelf to flow toward the front of the display section and mix with the air forming said inner air curtain.

10. A refrigerator according to claim 6, further comprising means for propelling and directing ambient air across said access opening to form a third air curtain exterior to said outer air curtain, said third air curtain being dissipated back into the atmosphere at its downstream end.

11. In a commercial refrigerator, suitable for use in supermarkets, having an open front display section and a rear storage section, the improvements comprising:

first air circulating fan means, and refrigeration coil means located downstream of said first fan means, wherein said first fan means is disposed to draw air from said storage section and propell said air through said refrigeration coil means;

first conduit means located downstream of said coil means for directing at least some refrigerated air propelled by said first fan means through said refrigeration coil means along a first path directly into said storage section and for directing other of said refrigerated air propelled by said first fan means through said coil means along a second path directly across the open front of said display section to form a relatively inner air curtain;

means for directing the downstream end of said inner air curtain across the front of said display section and into said storage section;

second air circulating fan means;

further conduit means for directing air propelled by said second fan means around the exterior of said storage and display sections and across said access opening to form a relatively outer air curtain; and frost collector means located adjacent the open front of said display section at the downstream end of said inner air curtain for removing moisture from said inner air curtain substantially at the entry point of room air into the refrigerated air path.

12. A refrigerator according to claim 11, further comprising:

third air circulating fan means located downstream of said frost collector means for drawing air through said frost collector means and propelling the defrosted air through the lower portion of said display section and into said storage section.

13. A refrigerator according to claim 11, further comprising:

means for diverting a portion of the refrigerated air propelled along said second path and for directing the diverted portion to flow first rearwardly across the top of the display section and then downwardly along the rear of the display section.

14. A refrigerator according to claim 13, further comprising:

means mounting at least one shelf in said display section, said shelf acting to divert at least a portion of the air flowing downwardly along the rear of the display section to flow toward the front of the display section and mix with the air forming said inner air curtain.

15. A refrigerator according to claim 14, further comprising: means mounting a second shelf in said display section below the first shelf, said second shelf diverting at least a second portion of air flowing downwardly along the rear of the display section and past said first shelf to flow toward the front of the display section and mix with the air forming said inner air curtain.

16. A refrigerator according to claim 11, further comprising means for propelling and directing ambient air across said access opening to form a third air curtain exterior to said outer air curtain, said third air curtain being dissipated back into the atmosphere at its downstream end.

17. A rear load open front refrigerator, comprising:

a cabinet having a top, a bottom, a front side and a rear wall;

an access opening in the front side of the cabinet for communicating said display section with the ambient atmosphere;

a first outlet extending across one edge of said access opening;

a first inlet extending across an opposite edge of said access opening;

a first conduit extending in an upstream direction from said first outlet;

refrigeration coil means located at the upstream end of said first conduit;

a second conduit extending at its upstream end from said refrigeration coil means and opening at its downstream end into said storage section;

first air circulating fan means for propelling air through said refrigeration coil means, through said first conduit from said first outlet to said first inlet across the access opening, and through said second conduit directly into said storage section;

means for returning air propelled into said first inlet across the front of said display section into said storage section;

a second outlet extending across said one edge of said access opening exteriorly of said first outlet relative to said display section;

a second inlet extending across said opposite edge of said access opening exteriorly of said first inlet relative to said display section;

a third conduit extending from said second inlet, around the bottom, back and top of said cabinet to said second outlet; and second air circulating fan means for propelling air through said first conduit from said second outlet across said access opening to said second inlet.

18. A refrigerator according to claim 17, wherein said rear wall contains a closable access opening large enough to permit movement therethrough of a rolling cart on which merchandise may be placed for display; and separating means between said storage and display sections also containing an access opening through which the rolling cart is movable into said display section.

19. A refrigerator according to claim 17, further comprising:

a plenum chamber located in a space within said cabinet above said display section, said refrigeration coil means being located in said plenum chamber;

said first and second conduits extending from the downstream end of said plenum chamber; and said first air circulating fan means being located at the upstream end of said plenum chamber.

20. A refrigerator according to claim 17, further comprising:

a third outlet extending across said one edge of said access opening;

a fourth conduit extending in an upstream direction from said third outlet; and third air circulating fan means for drawing ambient air into said fourth conduit and propelling said ambient air out through said third outlet across said access opening exteriorly of air propelled across said access opening from said second outlet to said second inlet, said ambient air being dissipated back into the atmosphere.

21. A refrigerator according to claim 17, wherein said first fan means draws air from said storage section and propells it through said refrigeration coils and into said first and second conduits.

22. In a commercial refrigerator, suitable for use in supermarkets, having an open front display section and a rear storage section, the improvements comprising:

first air circulating fan means, and refrigeration coil means located downstream of said first fan means, wherein said first fan means is disposed to draw air from said storage section and propell said air through said refrigeration coil means, said first fan means and said refrigeration coil means being contained in a plenum chamber located above said display section, the upstream end of said plenum chamber, containing said first fan means, opening into said storage section to provide a path for air drawn into said plenum chamber from said storage section by said first fan means;

first conduit means, for directing at least some refrigerated air propelled by said first fan means through said refrigeration coil means along a first path directly into said storage section and for directing other of said refrigerated air propelled by said first fan means through said coil means along a second path directly across the open front of said display section to form a relatively inner air curtain, said first conduit means comprising a bifurcated duct, having a first duct portion opening at its downstream end into said storage section, and a second duct portion terminating at its downstream end at a first outlet extending across one edge of the open front of said display section, the upstream ends of said first and second duct portions lying adjacent to each other and opening into said plenum chamber at the downstream side of said refrigeration coil means;

means for directing the downstream end of said inner air curtain across the front of said display section and into said storage section, said means including a first inlet provided on the opposite edge of the open front of said display section from the one edge containing said first outlet;

second air circulating fan means; and further conduit means for directing air propelled by said second fan means around the exterior of said storage and display sections and across said access opening to form a relatively outer air curtain.

23. A refrigerator according to claim 22, wherein said second conduit means is defined between inner and outer walls of said refrigerator, said second fan means being contained in said second conduit means, said second conduit means terminating downstream of said second fan means at a second outlet extending across the open front of said display section and lying exteriorly of said first outlet relative to said display section, said second conduit means emanating at its upstream end from a second inlet provided on said opposite edge of the open front of the said display section exteriorly of said first inlet, the air circulating through said second conduit means being warmer than the air circulating through said first conduit means and contacting the air passing through said first conduit means only in the region of the open front of said display section.

24. A refrigerator according to claim 23, further comprising:

means for diverting a portion of the refrigerated air propelled along said second path and for directing the diverted portion to flow first rearwardly across the top of the display section and then downwardly along the rear of the display section.

25. A refrigerator according to claim 24, further comprising:

means mounting at least one shelf in said display section, said shelf acting to divert at least a portion of the air flowing downwardly along the rear of the display section to flow toward the front of the display section and mix with the air forming said inner air curtain.

26. A refrigerator according to claim 25, further comprising: means mounting a second shelf in said display section below the first shelf, said second shelf diverting at least a second portion of air flowing downwardly along the rear of the display section and past said first shelf to flow toward the front of the display section and mix with the air forming said inner air curtain.

27. A refrigerator according to claim 23, further comprising means for propelling and directing ambient air across said access opening to form a third air curtain exterior to said outer air curtain, said third air curtain being dissipated back into the atmosphere at its downstream end.

28. A refrigerator according to claim 23, wherein said refrigeration coil means comprises:

a first set of coils having relatively widely spaced apart fins; and a second set of coils having relatively closely spaced aprt fins.

29. A refrigerator according to claim 28, wherein said first set of coils is disposed upstream of said second set of coils between said second set of coils and said first fan means.

* * * * *